US006588154B1

(12) United States Patent
Miller et al.

(10) Patent No.: US 6,588,154 B1
(45) Date of Patent: Jul. 8, 2003

(54) SWING IN SECURITY AND ESCAPE WINDOW

(75) Inventors: Patrick Thomas Miller, Allen Park, MI (US); Donald L. Speer, 16927 Hamilton, Allen Park, MI (US) 48101

(73) Assignee: Donald L. Speer, Allen Park, MI (US)

( * ) Notice: Subject to any disclaimer, the term of this patent is extended or adjusted under 35 U.S.C. 154(b) by 106 days.

(21) Appl. No.: 09/677,543

(22) Filed: Oct. 2, 2000

(51) Int. Cl.[7] ..... E06B 5/11; E06B 9/04
(52) U.S. Cl. ..... 49/401; 49/489.1
(58) Field of Search ..... 49/371, 380, 400, 49/401, 402, 489.1, 498.1, 141

(56) References Cited

U.S. PATENT DOCUMENTS

| | | | | | |
|---|---|---|---|---|---|
| 1,211,053 | A | * | 1/1917 | Bernard | 49/401 |
| 1,763,897 | A | | 6/1930 | Leindorf et al. | |
| 2,086,811 | A | | 7/1937 | Lewis | |
| 2,181,215 | A | | 11/1939 | Sweaney | |
| 2,701,631 | A | | 2/1955 | Stouder et al. | |
| 2,802,245 | A | | 8/1957 | Chapman | |
| 3,181,204 | A | * | 5/1965 | Muessel | 49/401 |
| 3,878,648 | A | * | 4/1975 | Maune | 49/400 |
| 3,890,741 | A | | 6/1975 | Johnson et al. | |
| 4,237,654 | A | | 12/1980 | Landem et al. | |
| 4,314,424 | A | * | 2/1982 | Gordon et al. | 49/400 |
| 4,447,985 | A | * | 5/1984 | Weber et al. | 49/402 |
| 5,850,710 | A | | 12/1998 | Brock | |
| 6,079,475 | A | * | 6/2000 | Morgan et al. | 49/402 |

* cited by examiner

*Primary Examiner*—Michael Safavi
(74) *Attorney, Agent, or Firm*—Harness, Dickey & Pierce, P.L.C.

(57) ABSTRACT

A swing in window with an optional security screen having an outer window frame, an inner window frame and a single sash that may be opened without invoking the swing in emergency egress option. The swing in window will provide a legal egress size opening for the escape of the dwelling occupants in the event of an emergency and provide a means to easily clean the exterior of the window. The swing in window provides welded, continuous sealing weather bulbs, an alignment shim, an internal snubber and a high tensile security screen with concealed fasteners to prevent fastener tampering by an intruder.

22 Claims, 5 Drawing Sheets

SWING IN SECURITY AND ESCAPE WINDOW

BACKGROUND OF THE INVENTION

1. Field of the Invention

This invention generally relates to escape windows. More particularly, the resent invention relates to a swing-in security and escape window for a dwelling.

2. Discussion of the Related Art

Windows are commonly employed in walls to provide a variety of uses. A few uses include decoration, to allow the passage of light and to allow people to see into an area that may otherwise be blocked by a wall. Windows are also employed to allow a path of egress in the event of an emergency. Some windows employ a vertically sliding single or double sash or a horizontally sliding pane of glass.

The problem with many windows is that they do not open for the purposes of providing an adequate means of escape for people in need of an emergency escape route. Many windows slide vertically or horizontally creating an opening to permit items to be passed through or to permit air to pass. In yet other designs, windows only pivot inwardly or outwardly through the use of a crank mechanism and remain attached to the window frame through the use of a hinge attached at the top and bottom of the peripheral window frame. These prior windows would commonly employ a screen to prevent objects from entering or exiting the interior of the dwelling or to prevent insects from entering the interior of the dwelling.

The problem with prior art windows is their lacking of important and desirable features. Those features consist of a window to provide a legal path of egress for people in the event of an emergency such as a fire. Furthermore, a quick, uncomplicated means of opening the window is desired instead of cranks, commonly employed on prior art windows. In many instances, when a legal egress window was desired in the present place of a non-legal egress size window, structural dwelling changes were required. This, however, is normally a costly solution to obtain the desired legal egress window. Additionally, many egress windows swing outward from the building in which they are installed, which causes potential problems with outside fixtures or adjacent structures that may prevent the egress window from being successfully opened during an emergency. Another problem with prior art windows is that water becomes trapped in the window sashes and window frame causing mold and mildew to form which creates a generally unclean, unhealthy environment for the occupants of the room or building in which the window is installed. Additionally, if left in the window, the trapped water may also find its way to the interior of the dwelling and result in damage to floors and walls or cause electrical hazards. Another problem with prior art windows is the rusting and corrosion of the hinges on which the window pivots. A further problem occurs when windows do not seal properly due to the use of metal to metal contacts instead of using satisfactory sealing materials such as rubber, PVC, or other elastomer. Additionally, general window design and fit prevent prior art windows from sealing. This permits outdoor elements to enter the sealed area and infiltrate the sashes and frames and ultimately the area of the dwelling in which the window is installed. Another problem with prior art windows is the misalignment of the movable, opening portion of the window relative to the peripheral window frame. This misalignment and non-sealing accounts for the seepage of outdoor elements into the sash and frame of the window. A further problem with prior art windows is that they lack a security feature to prevent the entrance of intruders into the interior of the dwelling. Finally, many prior art windows expose the fastening means by which the security device is attached which facilitates tampering with the fasteners and ultimately may permit entrance into the dwelling.

Thus, there is a need for a legal egress size swing in security window with a concealed fastener security screen that permits the drainage of water and other elements from the sash, sash tracks, inner window frame, and outer window frame while continuously sealing the inner window frame with the outer window frame.

SUMMARY OF THE INVENTION

Accordingly, this invention provides a swing in security window having an outer window frame and an inner window frame which swings inward relative to the dwelling in which the window is mounted. The inward swinging of the inner window frame will provide a fast, legal egress opening for the dwelling occupants. Additionally, the swing in window will provide the means to easily clean the window.

The security feature of the window comprises a high tensile security screen that is fastened to the inner window frame with fasteners that abut the outer window frame and remain concealed when the inner window frame is in the closed position. Additionally, when the inner window frame is in the closed position, a latch is used to lock the inner window frame to the outer window frame. Furthermore, a shim connected to the outer window frame facilitates the alignment of the inner window frame with the outer window frame when the inner window frame is closed. A snubber, opposite the latch side of the window, ensures that the frames remain parallel and sealed by multiple, continuously welded, flexible PVC weather bulbs that traverse the inside of the outer window frame and provide a continuous, unbroken seal when the inner window frame is closed.

Lastly, the invention provides a single sash that slides vertically along the inner window frame sash track to allow access to outside air without utilizing the emergency egress option or breaching the emergency screen feature of the inner window frame.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

Further features and advantages of the invention will become apparent from the following discussion and accompanying drawings, in which.

DETAILED DESCRIPTION OF THE PREFERRED EMBODIMENT

The following description of the preferred embodiment is merely exemplary in nature, and is in no way intended to limit the invention, or its application, or uses.

Figure 1:
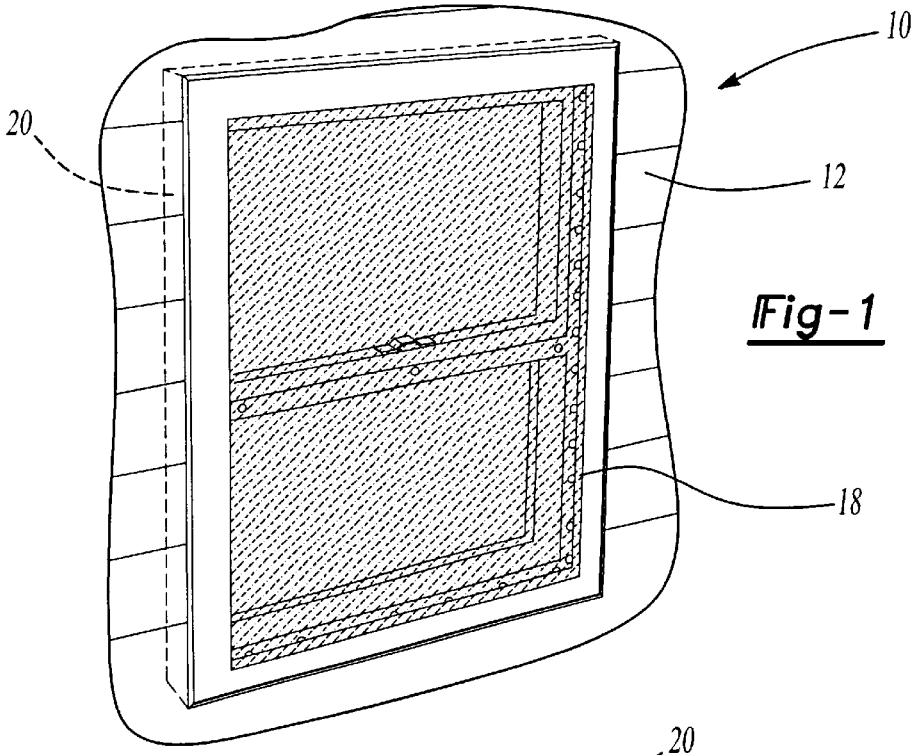
FIG. 1 is a view of the installed security window as it would look from the outside of a dwelling in which it would be mounted.
Figure 2:
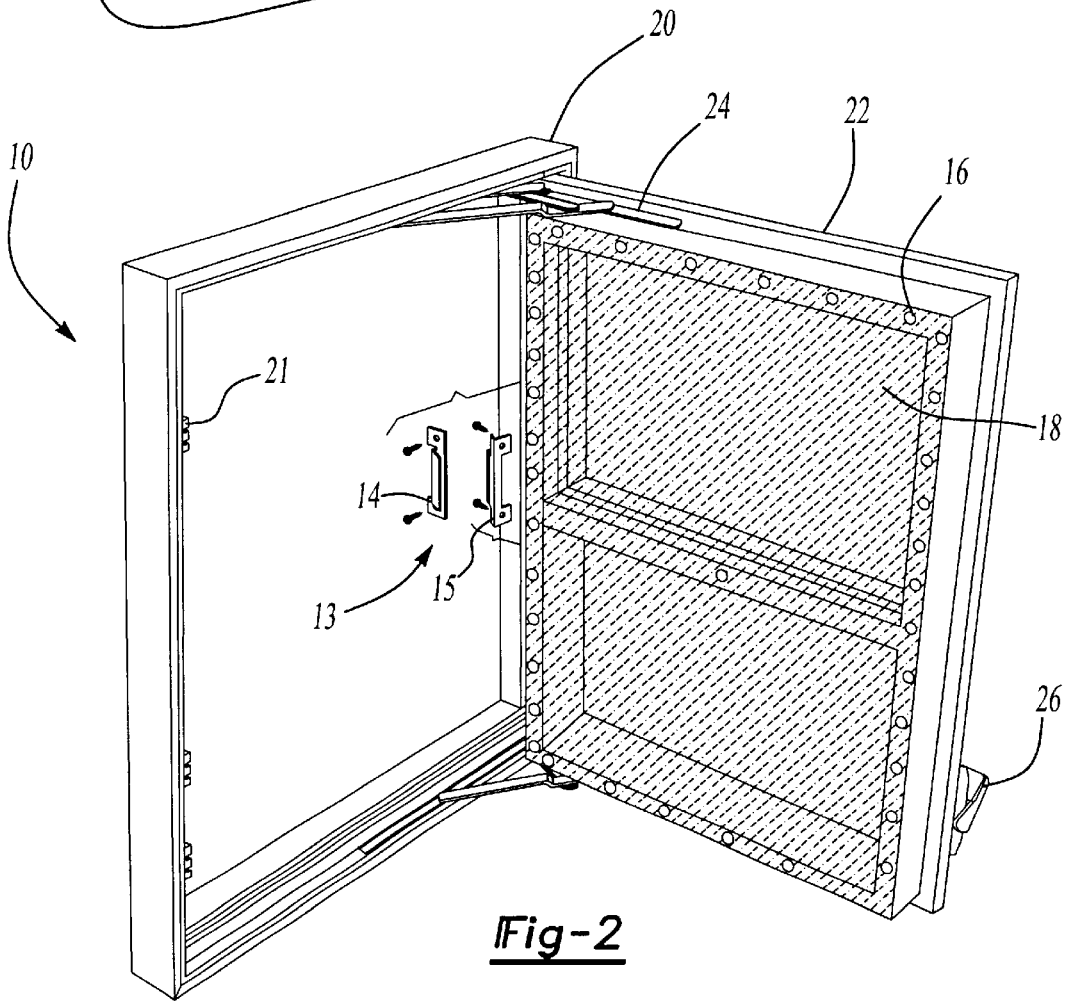
FIG. 2 is a perspective view of the security window as it would look from the inside of a dwelling with the swing in window feature in its open position.

FIG. 1 shows a perspective view of the closed security window 10 in place as it would be seen from the exterior of a dwelling. FIG. 2 shows the security window 10 with its outer window frame 20 mounted in the dwelling wall 12 with the security screen 18 secured to the inner window frame 22 with the swing in feature invoked. The inner window frame can be opened when the window latch 26 is in an upwardly, unlocked position. FIG. 2 also shows a window hinge 24 comprised of four separate, flat bars attached to the inner window frame 22 and outer window frame 20 to permit the inner window frame 22 to swing between its closed position of FIG. 1 and its open position of FIG. 2. The hinge bars can be manufactured from a variety of materials but are preferably manufactured from a non-corrosive and rustproof material such as stainless steel.

Figure 3:
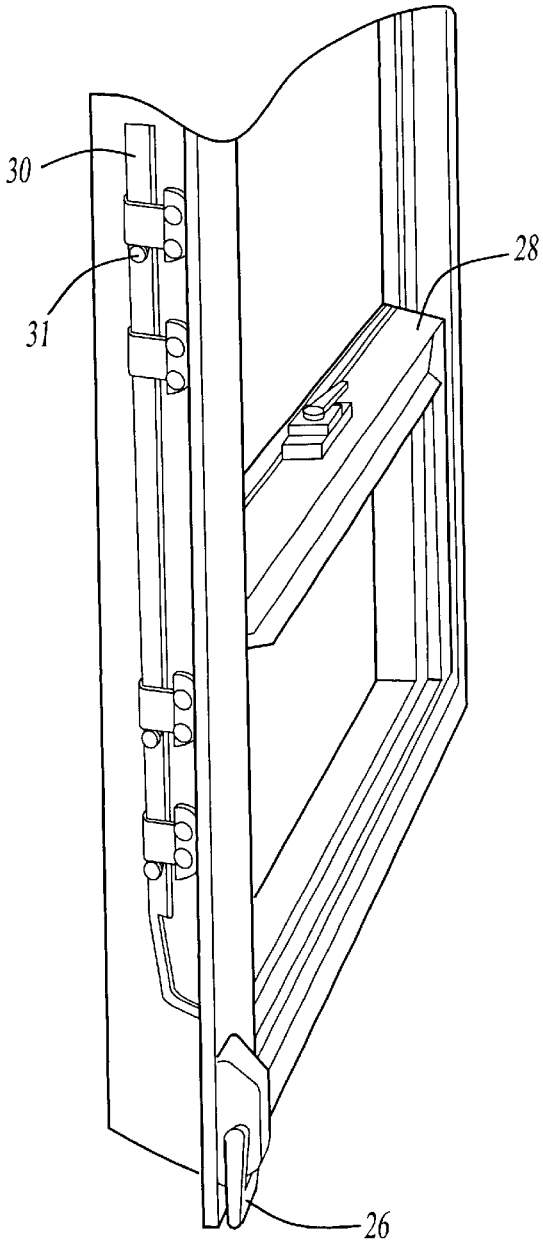
FIG. 3 is a side view of the inner window frame showing the latch and locking mechanism in its engaged, locked position.
Figure 4:
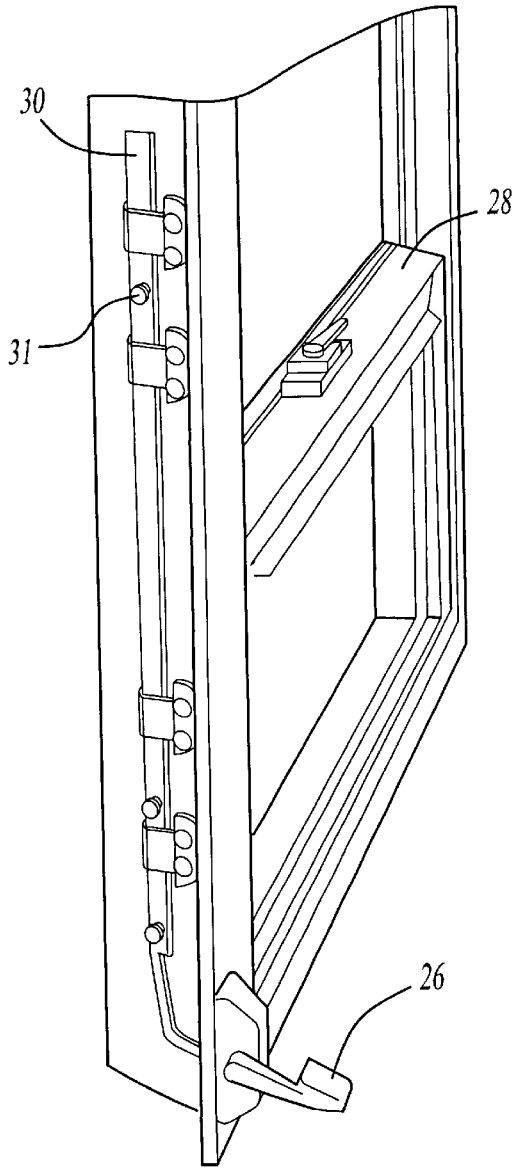
FIG. 4 is a side view of the inner window frame showing the latch and locking mechanism in its unengaged, unlocked position.

FIG. 3 is a side view showing the latch 26 in its downwardly, locked position and the associated locking bar 30 and locking nodules 31 which engage the nodule receptacles 21 on the outer window frame 20, to place the inner window frame 22 in a locked position. A movable lower sash 28 is shown in its closed position and may be moved vertically to permit the free flow of air into the area separated by the window. FIG. 4 shows the latch 26 in one of its intermediate positions to permit the inner window frame to swing inward upon pulling on the latch 26.

Figure 5:
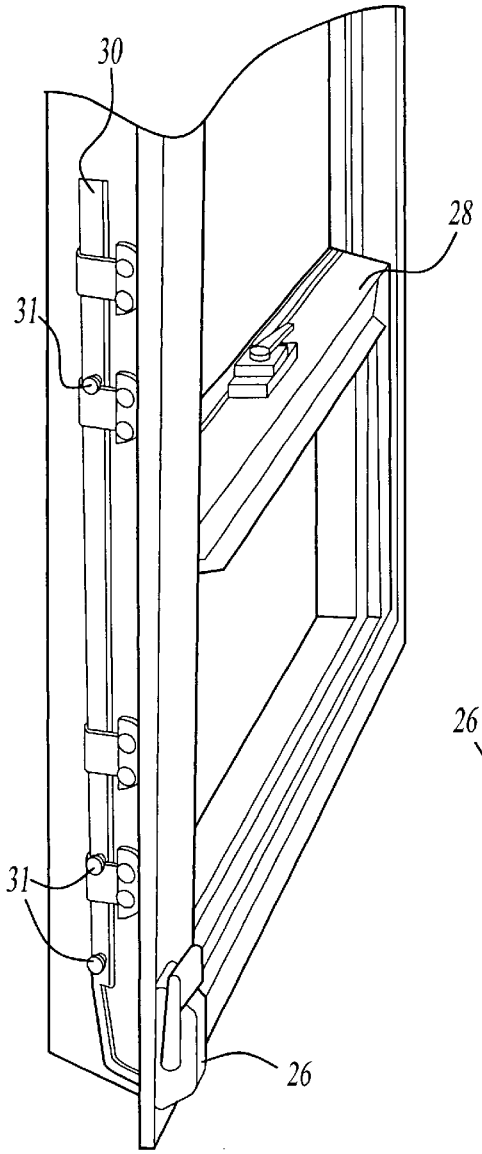
FIG. 5 is a side view of the inner window frame showing the latch and locking mechanism in another unengaged, unlocked position.
Figure 6:
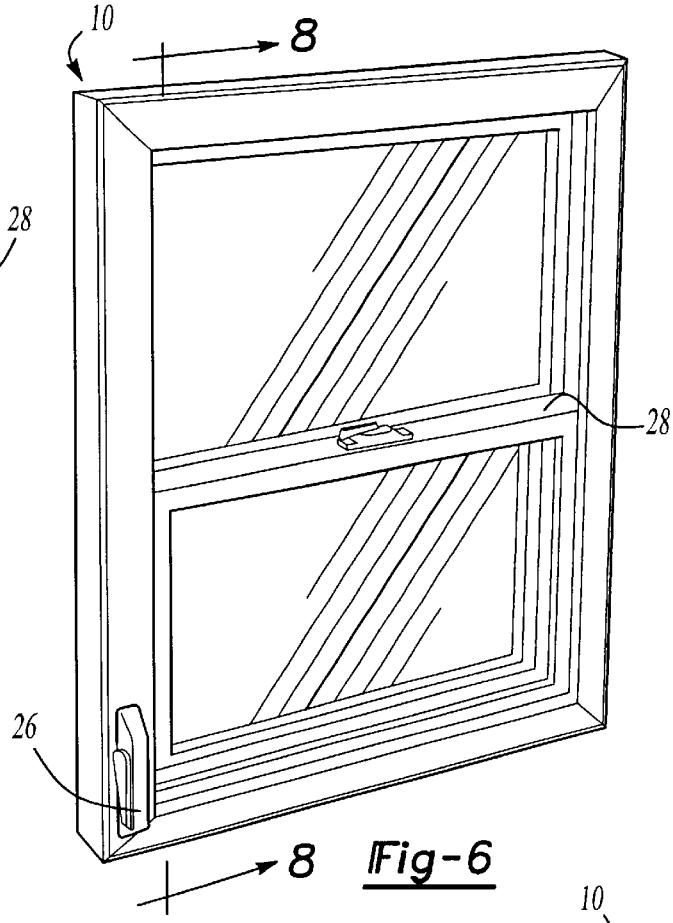
FIG. 6 is a view of the window from the interior of the dwelling without the security screen option in place.
Figure 7:
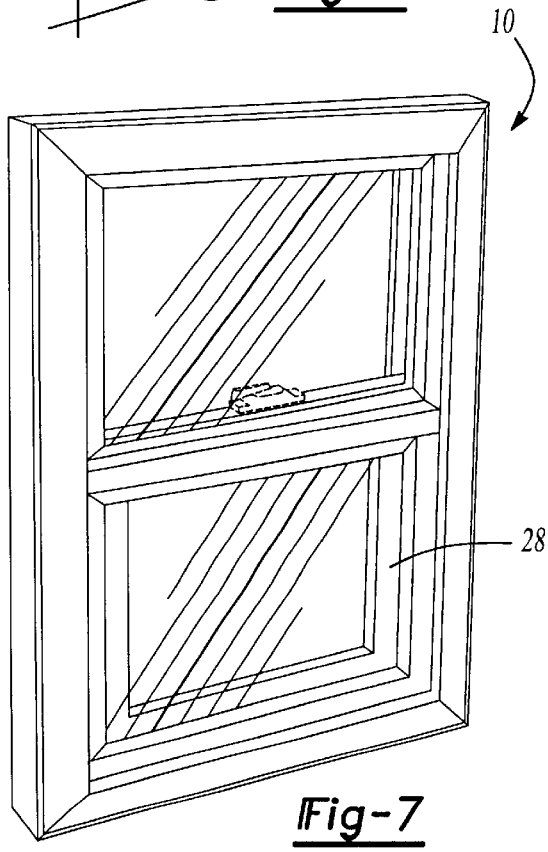
FIG. 7 is a view of the window from the exterior of the dwelling without the security screen option in place.

FIG. 5 shows the latch 26 in its upwardly, unlocked position which disengages the locking nodules 31 with the nodule receptacles 21. The latch 26 is located in the lower left corner of the inner window frame 22, but could be located in the lower right corner in the event that the window 10 is to be installed in a place that makes it impossible or inconvenient for the inward swinging of the window. In such a case, the hinge 24 could be located on the left side of the window 10 instead of the right side when viewed from the inside perspective of FIG. 2. In either event, the swing in window 10 will have its latch 26 located on the side opposite the window hinge 24. FIG. 6 shows the swing in window 10 from the interior of a dwelling in which it is mounted and FIG. 7 shows the swing in window 10 from the exterior of a dwelling in which it is mounted.

Figure 8:
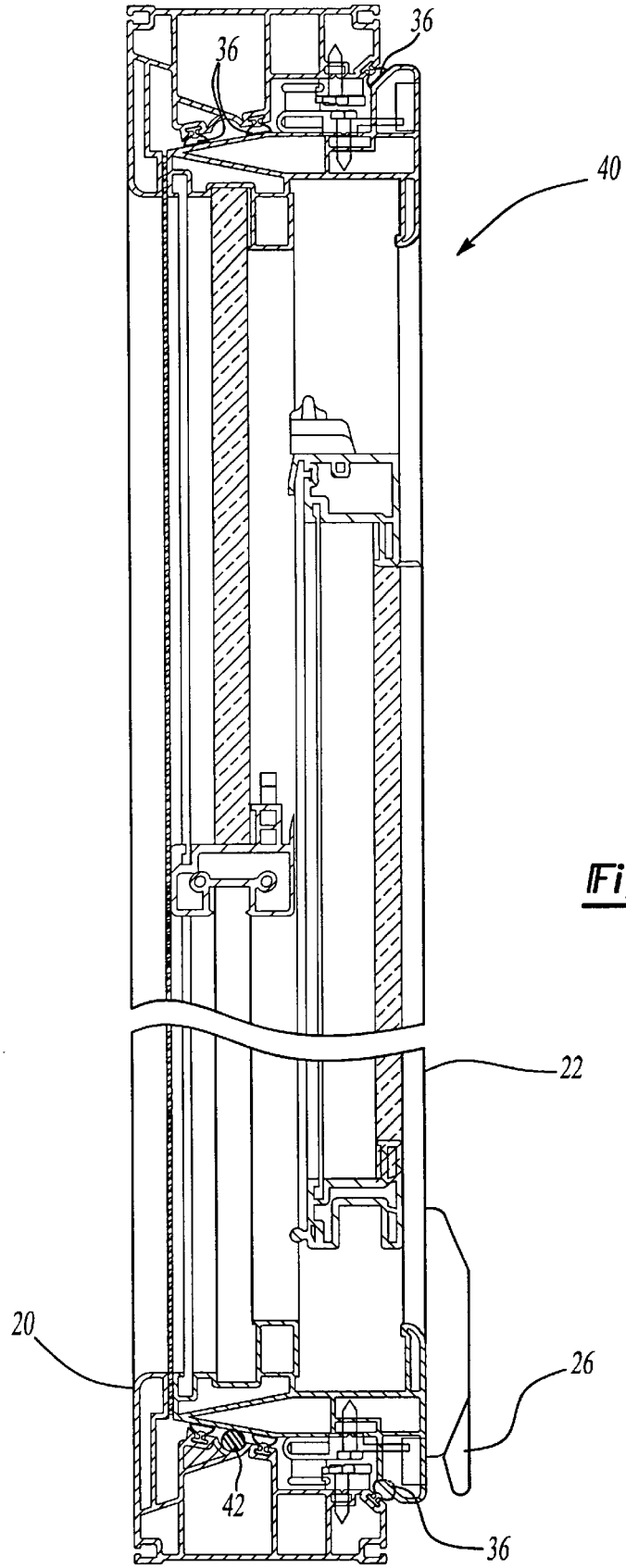
FIG. 8 is a section view of the locked security window showing the inner and outer window frames, latch, continuous PVC bulbs, shim, and sash.
Figure 9:
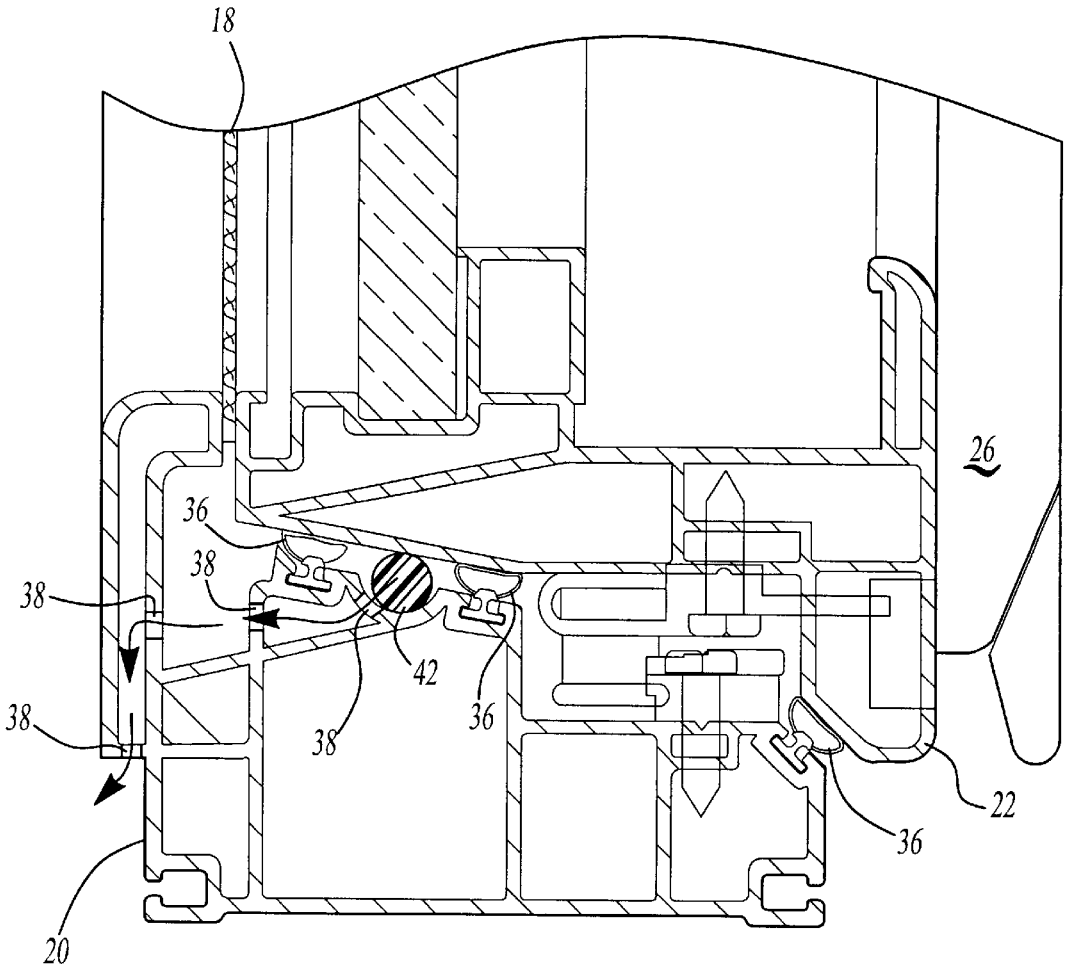
FIG. 9 is an enlarged section view of the bottom portion of the security window in its closed position showing the details of the drainage path and holes, the continuous PVC bulbs and the shim.

FIG. 8 shows a section view 40 of the inner window frame 22 and outer window frame 20 of the swing in window 10 taken from FIG. 6. FIG. 9 is an enlarged sectional view of the swing in window 10 showing the details of how the inner window frame 22 meets the continuously welded PVC bulbs 36 to ensure the proper sealing of the inner window frame 22 to prevent exterior elements such as rainwater from entering the interior of the dwelling 12 in which the swing in window 10 is installed. Additionally, FIG. 9 details the seating of the inner window frame 22 against the shim 42 to align the inner window frame 22 with the outer window frame 20, thereby preventing crushing of the PVC bulbs.

Figure 10:
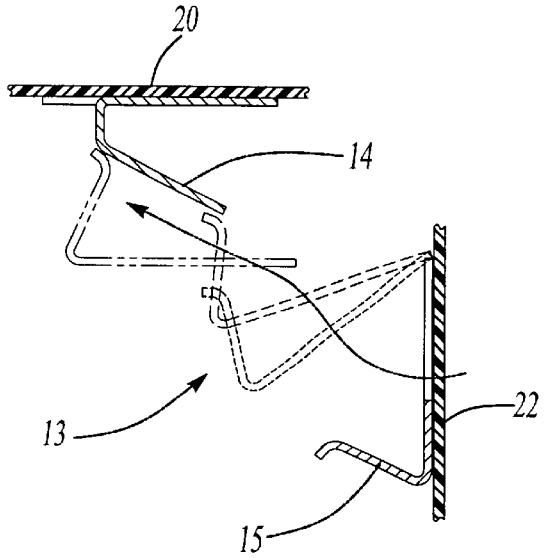
FIG. 10 shows an internal snubber consisting of an outer frame snubber piece and an inner frame snubber piece.

FIG. 10 shows an internal snubber 13 consisting of an outer frame snubber piece 14 and an inner frame snubber piece 15. The internal snubber 13 acts to ensure that the outer window frame 20 and inner window frame 22 remain parallel and sealed when the inner window frame 22 is in a closed position.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A window for a dwelling having an interior and an exterior, said window comprising:

an outer window frame mounted to an exterior wall of the dwelling;

an inner window frame pivotally connected to the outer window frame to permit the inner window frame to swing inwardly to provide easy egress by occupants within the dwelling in the event of an emergency;

a security screen having peripheral edges affixed to peripheral portions of an exterior side of the inner window frame such that when the inner window frame is seated within the outer window frame, the peripheral edges of the security screen are sandwiched between the peripheral portions of the inner window frame and the outer window frame to thereby impede unauthorized removal of the security screen; and a shim located in the outer window frame and contacting a peripheral portion of the inner frame to facilitate the alignment of the inner window frame with the outer window frame upon closing the inner window frame;

wherein the shim is a flexible rod having a circular cross-section.

2. The window of claim 1 which further comprises a latch for locking the inner window frame to the outer window frame.

3. The window of claim 1 which further comprises:

a shim connected to said outer window frame to facilitate the alignment of said inner window frame with said outer window frame upon closing the inner window frame.

4. The window of claim 1 which further comprises:

a snubber to ensure that the inner window frame and the outer window frame remain parallel and sealed.

5. The window of claim 1 which further comprises an upper hinge and a lower hinge.

6. The window of claim 5, wherein each hinge comprises four members.

7. The window of claim 6, wherein the upper and lower hinges are manufactured from a rust or corrosion resistant material.

8. The window of claim 1 which further comprises at least one weather bulb, the weather bulb to provide a continuous weather seal around the inner portion of the outer window frame.

9. The window of claim 8 further comprising a single piece of pliable weather resistant material.

10. The window of claim 1, further comprising a single sash slidably connected to the inner window frame to allow access to outside air without utilizing the emergency egress option or breaching the security screen feature of the inner window frame.

11. The window of claim 1 further comprising a plurality of weep holes to facilitate drainage through the outer window frame, the inner window frame, and the sash.

12. The window of claim 1 wherein the security screen is manufactured of high tensile steel to prevent access to the interior of the dwelling through the security screen.

13. The window of claim 1, wherein the security screen is affixed to the inner window frame by fasteners, and wherein the fasteners are concealed within the window when the inner window frame is seated within the outer window frame.

14. A window for a dwelling having an interior and an exterior, said window comprising:

an outer window frame mounted to an exterior wall of the dwelling;

an inner window frame pivotally connected to the outer window frame to permit the inner window frame to swing inwardly to provide easy egress by occupants within the dwelling in the event of an emergency; and a shim located in the outer window frame and contacting a peripheral portion of the inner frame to facilitate the alignment of the inner window frame with the outer window frame upon closing the inner window frame;

wherein the shim is a flexible rod having a circular cross-section.

15. The window of claim 14, wherein the outer window frame is comprised of at least one weep hole providing a passageway from an area mating with the inner window frame to an exterior of the dwelling.

16. The window of claim 14, wherein two seals extend from the outer frame on opposite sides of the shim.

17. The window of claim 14, wherein a seal extends from an interior surface of the outer window frame so as to prevent the flow of liquid within the dwelling.

18. A window for a dwelling having an interior and an exterior, said window comprising:

an outer window frame mounted to an exterior wall of the dwelling;

an inner window frame pivotally connected to the outer window frame to permit the inner window frame to swing inwardly to provide easy egress by occupants within the dwelling in the event of an emergency;

at least one weep hole within the outer window frame to facilitate drainage through the outer window frame to an exterior of the dwelling; and wherein the at least one weep hole is located within a recess of the outer window frame containing a shim, the weep hole located on a side of the shim closest an exterior of the dwelling.

19. The window of claim 18, wherein the inner window frame is comprised of at least one weep hole providing a passageway from an area mating with the inner window frame to an exterior of the dwelling.

20. The window of claim 18, wherein the at least one weep hole comprises a series of weep holes located within a sash to provide a passageway from the sash to an exterior of the dwelling.

21. A window for a dwelling having an interior and an exterior, said window comprising:

an outer window frame mounted to an exterior wall of the dwelling;

an inner window frame pivotally connected to the outer window frame to permit the inner window frame to swing inwardly to provide easy egress by occupants within the dwelling in the event of an emergency;

a shim located in the outer window frame and contacting a peripheral portion of the inner frame to facilitate the alignment of the inner window frame with the outer window frame upon closing the inner window frame, the shim being a flexible rod having a circular cross-section;

at least one weep hole within the outer window frame to facilitate drainage through the outer window frame to an exterior of the dwelling, the weep hole located within a recess of the outer window frame containing the shim, the weep hole located on the side of the shim closest an exterior of the dwelling; and a snubber to ensure that the inner window frame and the outer window frame remain parallel and sealed.

22. The window of claim 21, wherein the snubber is comprised of:

a first guide secured to the outer window frame;

a second guide secured to the inner window frame;

wherein the first and second guides mate with each other when the inner window frame is seated within the outer window frame.

* * * * *